US005884969A

United States Patent [19]

Gebhard

[11] Patent Number: 5,884,969

[45] Date of Patent: Mar. 23, 1999

[54] RELEASE FOR A HEIGHT ADJUSTMENT OF BACK RESTS

[75] Inventor: Reinhard Gebhard, Burgthann, Germany

[73] Assignee: SIFA Sitzfabrik GmbH, Germany

[21] Appl. No.: 913,113

[22] PCT Filed: Jan. 4, 1997

[86] PCT No.: PCT/DE97/00002

§ 371 Date: Dec. 19, 1997

§ 102(e) Date: Dec. 19, 1997

[87] PCT Pub. No.: WO97/24959

PCT Pub. Date: Jul. 17, 1997

[30] Foreign Application Priority Data

Jan. 10, 1996 [DE] Germany ..... 29600333 U

[51] Int. Cl.[6] ..... A47C 7/40

[52] U.S. Cl. ..... 297/353; 248/412

[58] Field of Search ..... 297/353, 411.36; 248/295.11, 316.2, 316.3, 411, 412

[56] References Cited

U.S. PATENT DOCUMENTS 1,075,323 10/1913 Benjamins ..... 248/412

1,101,552 6/1914 Hume ..... 248/412

3,467,352 9/1969 Bohler ..... 248/412 X

*Primary Examiner*—Peter R. Brown

*Attorney, Agent, or Firm*—Morrison Law Firm

[57] ABSTRACT

A release for a seat-back height adjuster, especially for office chairs, in which the height adjuster consists of a housing (1) in which a flat seat-back bearer (2) is held by a ball catch clamp (3, 4), where the seat-back bearer (2) has recesses or apertures (3) arranged one behind the other for locking balls (4) which are held in the recesses of apertures by means of spring-loaded clamping bevels (5'), and in which the clamping bevel (5') can be disengaged against the force of the spring by a caliper (8) guided laterally out of the housing (1), where there is a base plate (7) secured in the housing (1) which has a groove (16) fitted in the axis of the caliper (8) having a narrower cross section for the end of the caliper (8) at which the latter is inserted into the housing (1) and the base plate (7), and the groove (16) has a broader cross section in which a shuttle (5) provided with the clamping bevel (5') for the ball (4) and is wider than the narrower cross section of the groove (16), is slidingly guided by the caliper (8) against the force of a spring which is supported on the end of the groove opposite the caliper (8).

2 Claims, 2 Drawing Sheets

FIG. 1
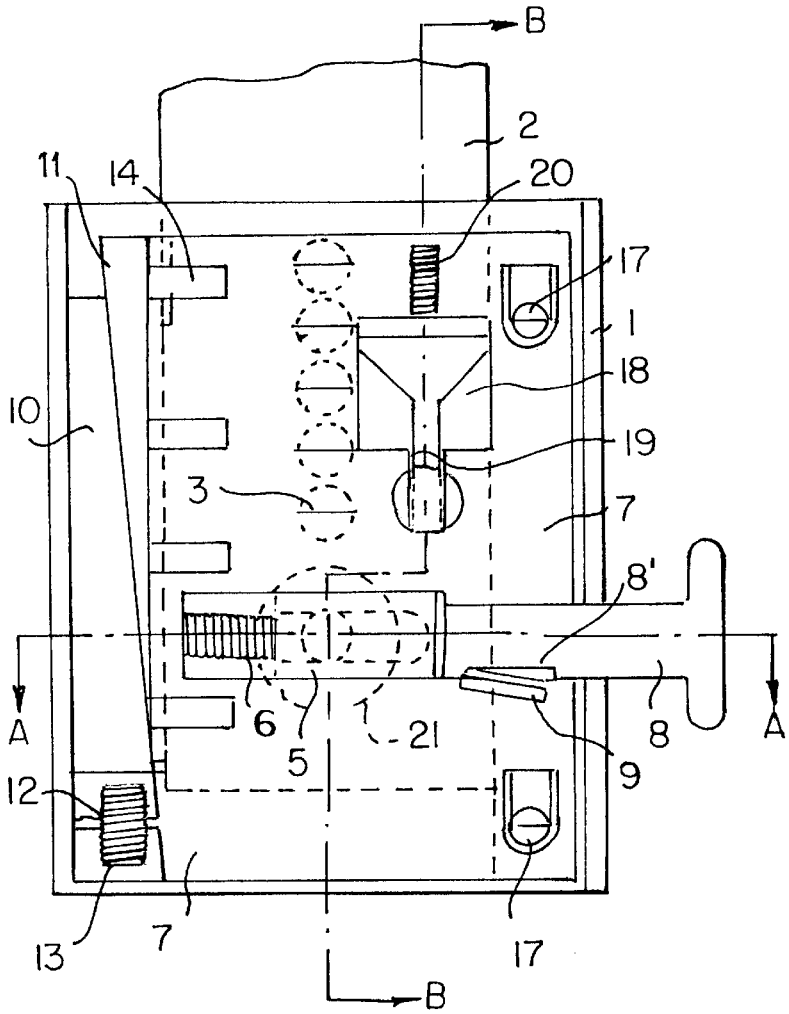
FIG. 3
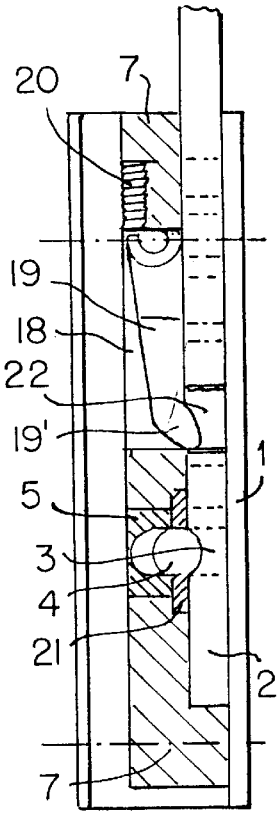
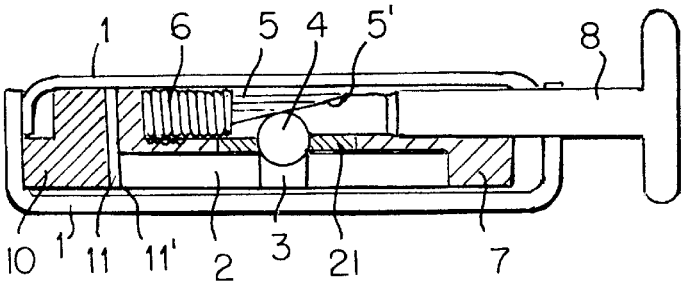
FIG. 2

FIG. 4b
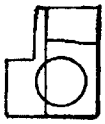
FIG. 4d
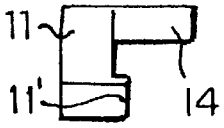
FIG. 4f
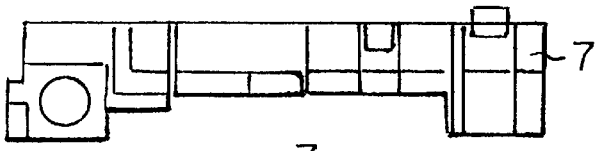
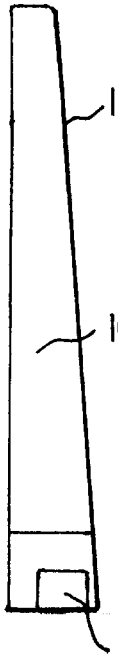
FIG. 4a
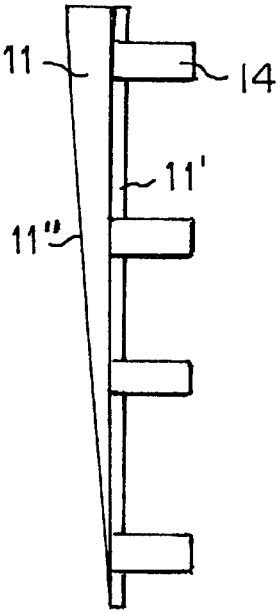
FIG. 4c
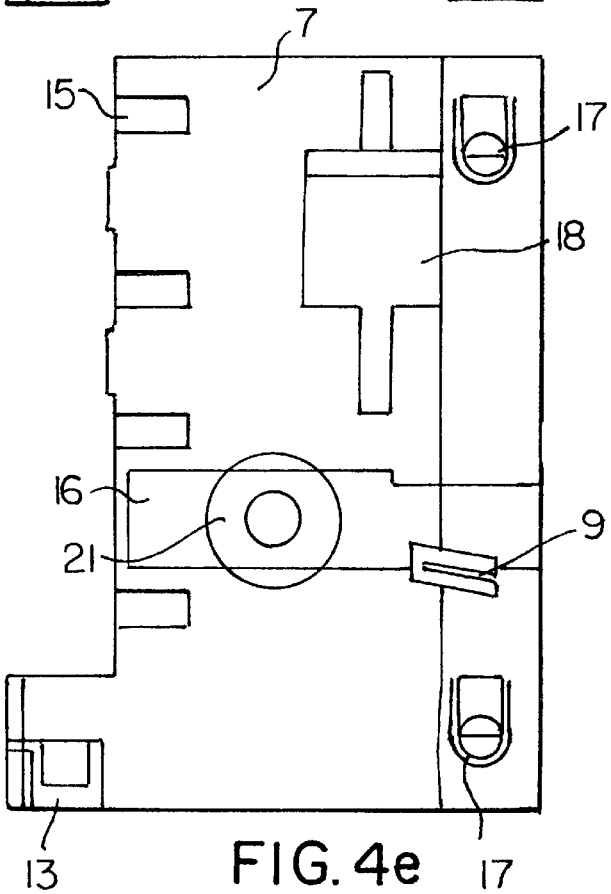
FIG. 4e
FIG. 5a
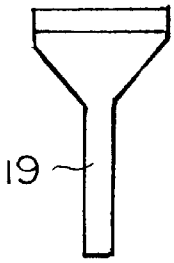
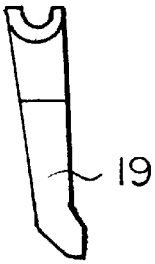
FIG. 5b
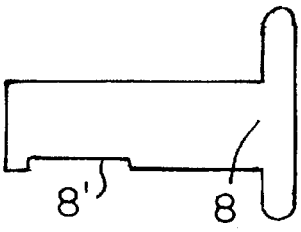
FIG. 6a
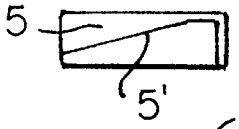
FIG. 6c
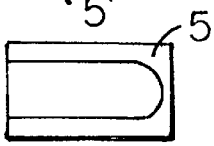
FIG. 6b

RELEASE FOR A HEIGHT ADJUSTMENT OF BACK RESTS

DESCRIPTION

The invention relates to a release for a height adjustment for back rests.

Such a height adjustment for back rests of chairs, in particular office chairs, consisting of a housing in which a flat back rest carrier is held by a detent ball clamping arrangement, whereby the back rest carrier is provided in axial direction with successively arranged indentations or openings for detent balls which are held in the indentations or openings by a spring-loaded clamping bevel, and whereby a push button that extends laterally from the housing can be used to move the clamping bevel against the elastic force to disengage it, is known, for example, from EP-A-O 264 555.

The objective of the present invention is to create a release for a height adjustment of the type mentioned above in which the same mechanics are simply equipped with different push-buttons and which also forms a unit without push-buttons, from which no parts are lost.

Further developments and advantageous embodiments of the invention are described hereinafter.

According to the invention, fastened in the housing is a base plate which is provided with a groove arranged approximately in the axis of the push-button and which has a narrower section for the end of the push-button with which the same is inserted in the housing and the base plate. Following the narrower section, the groove has a wider section in which a shuttle, which contains the clamping bevel for the ball and which is wider than the narrower section of the groove, is slidably guided by the push-button against the force of a spring which is supported at the end of the groove opposite the push-button. The step at the transition from the narrower to the wider section of the groove serves as a stop for the shuttle.

Advantageously, the push-button is provided with a recess inside the housing in which a spring, catch or some such is engaged in the base plate. According to a preferred embodiment of the invention, the spring, catch or some such is inseparably engaged against the pull of the push-button.

The invention is described below by way of example and with reference to the drawings, in which:

FIG. 1 to 3 show three views of a height adjustment including a top view in FIG. 1 with the upper housing part cut away, in FIG. 2 a section along the line A—A, and in FIG. 3 a section along the line B—B of FIG. 1;

FIG. 4*a* to 6*c* show separate components from FIG. 1.

The height adjustment according to FIG. 1 to 6*c* consists of a flat housing 1, with a substantially rectangular cross section, in which a flat back rest carrier 2 is slidably guided and can be clamped. The housing can be extended at the bottom and connected to a seat carrier. It can also have different dimensions than those shown, and it can have a curved shape.

Along its center axis, back rest carrier 2 is provided with a number of holes 3 which define the insertion depth. In one of these holes 3 is a detent ball 4 which is pressed into the hole by a clamping bevel 5' of a shuttle 5. The pressure results from a spring 6 which is supported in a base plate 7 fastened in housing 1, for example by means of screws 17 or catches. Base plate 7 is provided with a groove 16 in which the shuttle 5 can slide and on which the side opposite spring 6 comes to a stop. On this side, shuttle 5 is adjoined by a push-button 8 with which it can be pushed back against the force of spring 6, upon which clamping bevel 5' releases the ball 4, and the back rest can be moved until the desired insertion depth is reached, and the push-button 8 is released again. Push-button 8 has a flat recess 8' in which a small spring 9 engages during installation, which means that push-button 8 can no longer be pulled out. This measure prevents the unintentional release of push-button 8 and provides an opportunity to insert different shapes of push-buttons in the same height adjustment without problem. Since the base plate 7 is preferably made of plastic, a metal washer 21 is inserted in the area where the detent ball 4 pushes against the clamping bevel 5', to ensure proper functioning at all times.

Base plate 7 extends from the side of the push-button 8 across a large portion of the base surface of housing 1; it has a running surface and a stop edge for back rest carrier 2. On the other side, back rest carrier 2 adjoins at a step 11' the straight side of a wedge 11 whose bevel 11" adjoins bevel 10" of a second wedge 10, which in turn adjoins the inside housing wall with its straight side. The second wedge 10 is spring-loaded at its wide end with a pressure spring 12 which is supported in a ledge 13 of the base plate. The spring 12 pushes wedge 10 upward as shown in FIG. 1, which via bevels 10" and 11" conducts a lateral force onto back rest carrier 2, which is thus guided without play. Base plate 7 is provided with grooves 15 which are open toward the first wedge 11 and slidably accommodate guide journal 14 (FIG. 4*c* and 4*c*). Thus, this wedge 11 is guided and cannot give way.

The height adjustment is provided with a pull-out lock which is shown in FIG. 1 and 3 in staggered position. This pull-out lock has a hole 22 which actually must lie next to the last hole 3 for the detent ball or in FIG. 1 even below it. Arranged above this hole 22 in a recess 18 of base plate 7 is a pivotable detent arm 19 which is spring-loaded with a spring 20 supported in base plate 7 in such a way that its catch 19'—as shown in FIG. 3—is pressed into hole 22 as soon as the back rest is pulled out far enough. Then the back rest is blocked. Detent arm 19 does not prevent it from being pushed in, since it has a bevel in that direction.

I claim:

1. Release mechanism for a chair back rest height adjustment, the height adjustment including a housing in which a flat back rest carrier is held by a detent ball clamping arrangement, the back rest carrier being provided with successively arranged indentations or openings for a detent ball held in the indentations or openings by means of a clamping bevel engagable with the detent ball and a spring normally urging the clamping bevel into engagement with said detent ball, and the clamping bevel being disengaged from the spring loading by a push-button laterally extending from the housing, the release mechanism comprising a base plate carried in the housing, the base plate being provided with a groove disposed co-directionally with an axis of the push-button, the groove having a narrower section for receiving an end of the push button inserted into the housing and the base plate, the groove being provided with a wider section in which a shuttle is received, which shuttle carries the clamping bevel for the detent ball, said shuttle being wider than the narrower section of the groove, the shuttle being slidably guided by the push-button against the force of a spring which is supported at an end of the groove that lies remotely opposite the push-button.

2. Release mechanism for a chair back rest height adjustment in accordance with claim 1, in which a part of the push-button locating inside the housing carries a recess, the base plate carrying a catch engagable in the recess for retentively securing the push-button in the base plate.

* * * * *